US005199793A

United States Patent [19]

Jackson

[11] Patent Number: 5,199,793

[45] Date of Patent: Apr. 6, 1993

[54] COLLAPSIBLE STORAGE BAG

[76] Inventor: Chad S. Jackson, 15821 Shamrock La., Ft. Myers, Fla. 33912

[21] Appl. No.: 879,413

[22] Filed: May 7, 1992

[51] Int. Cl.[5] ..... B65D 33/01

[52] U.S. Cl. ..... 383/41; 383/67; 383/96; 383/103; 383/906; 220/905

[58] Field of Search ..... 383/3, 41, 66, 67, 96, 383/100, 103, 904, 906; 220/403, 565, 905, 723; 137/584

[56] References Cited

U.S. PATENT DOCUMENTS

| | | | |
|---|---|---|---|
| 500,773 | 7/1893 | Perelli-Minetti | 383/906 X |
| 2,633,172 | 3/1953 | Treiber . | |
| 2,696,235 | 12/1954 | Toffolon | 383/41 X |
| 2,851,075 | 9/1958 | Palfey | 220/565 |
| 2,915,097 | 12/1959 | Lewis . | |
| 2,969,102 | 1/1961 | Cunningham . | |
| 3,747,800 | 7/1973 | Viland | 220/723 |
| 3,801,402 | 4/1974 | Suter | 220/905 x |
| 3,951,284 | 4/1976 | Fell et al. | 220/1.5 X |
| 4,573,508 | 3/1986 | Knaus . | |

FOREIGN PATENT DOCUMENTS

| | | | |
|---|---|---|---|
| 0126527 | 1/1948 | Australia | 220/905 |
| 2146463 | 3/1973 | Fed. Rep. of Germany | 220/403 |
| 2330610 | 6/1977 | France | 220/905 |
| 0932966 | 7/1963 | United Kingdom | 383/3 |

*Primary Examiner*—Allan N. Shoap
*Assistant Examiner*—Jes F. Pascua
*Attorney, Agent, or Firm*—Merrill N. Johnson

[57] ABSTRACT

A collapsible storage bag for holding large volumes of liquid which can be moved to a desired location where it serves as a temporary liquid storage container, then quickly emptied entirely and then folded up and moved to a new location. The storage bag includes an upper sheet of flexible sheeting, a lower sheet of flexible sheeting whose outer edges are securely joined to the outer edges of the upper sheet of sheeting to form the storage bag, an open vent located at the center of the upper sheet of sheeting, one or more sealable filling and emptying ports located along one side of the upper sheet of sheeting, and a plurality of sealable drain holes equally spaced apart and each located closely adjacent to the outer edge of the lower sheet of sheeting.

8 Claims, 1 Drawing Sheet

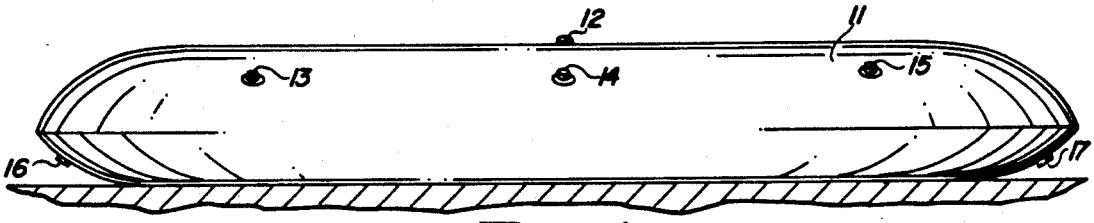
FIG. 1
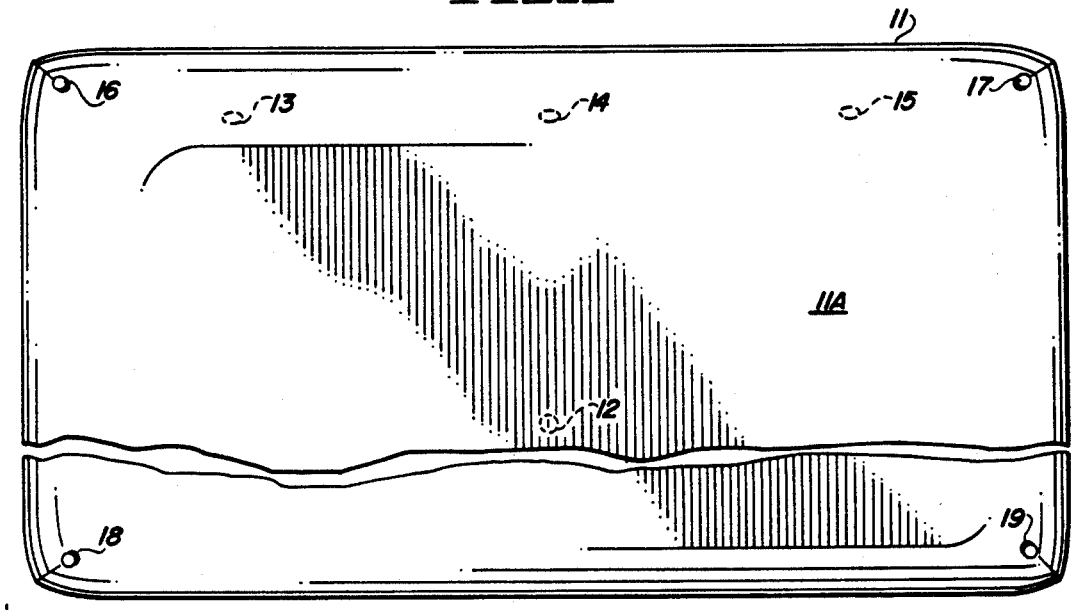
FIG. 2
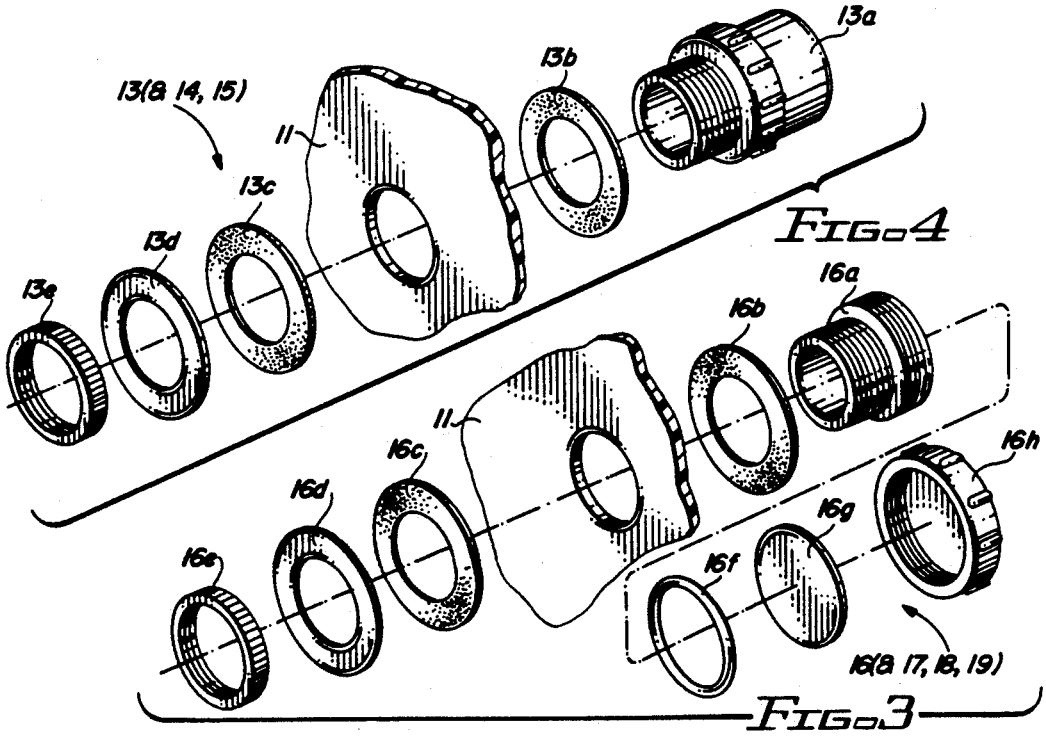
FIG. 4
FIG. 3

COLLAPSIBLE STORAGE BAG

BACKGROUND AND SUMMARY OF THE INVENTION

My invention generally relates to a collapsible bag or tank and more particularly to a large storage bag made of impervious flexible sheeting which can be moved to a desired location where it serves as a temporary liquid storage container, then emptied and folded up and moved to a new location.

Collapsible bags made of flexible sheeting are well known and have been used by both industry and the military to serve as temporary storage containers for water, gasoline and chemicals in remote locations. See, for example, the collapsible storage bags and tanks shown in U.S. Pat. Nos. 2,633,172; 2,915,097; 2,969,102 and 4,573,508.

However, the critical water shortage in many areas plus ecologically generated regulations have created a need for a unique form of collapsible storage bag.

It is frequently necessary to drain all of the chemically treated water from a swimming pool, spa or jacuzzi in order to effect repairs such as the marciting of the pool's surface which usually takes a couple of days. Then it is necessary to fill the pool, conventionally with new water from the public water system to which the necessary chemicals must then be added as required to purify the water and prevent algae and other organic growth in the pool.

Draining the water from the pool through the pool's regular drain pipes presents three problems. First, such drainage is slow and means paying the repairmen called in for time when they are relatively idle waiting for the water to drain out of the pool. Secondly, the chemicals in the pool water are lost and must be replaced when the repairs are finished and the pool filled with untreated water. Thirdly, the water must be replaced creating a drain on existing supplies of fresh water which in many areas are extremely limited.

An alternative which eliminates all three problems is to use one or more pumps to pump the water out of the pool and into a temporary storage bag brought in empty and folded up by truck or flat bed trailer to the pool site. The pool water pumped into the storage bag can be tested and any additives needed to adjust the stored water to its desired condition while the repairs are being done. Then when the repairs are completed, the water in the storage bag can be quickly pumped back into the pool and the pool is ready for use without any loss of scarce water or expensive additives.

The only step necessary to complete the operation is to quickly drain all the residual water out of the storage bag. Unless the bag is completely empty, it cannot be folded up to fit onto the bed of a flat bed trailer or into a truck.

I have invented a unique form of collapsible storage bag especially designed to be used for temporary storage of water pumped out of a pool, spa or jacuzzi. In its preferred form the bag will hold about 15,000 gallons of water and measures about 24 feet by 24 feet square in plan view.

The bag is made from two layers of impervious polyvinyl sheeting whose outer edges are securely welded or bonded together to form the collapsible storage bag.

In order to expel air from the bag as water is pumped into it, a vent is provided in the center of the top of the bag. In order to quickly pump the water from the pool and into the bag, a plurality of filling and emptying ports are provided in the side of the bag, which ports when not in use are sealed to prevent water from escaping from the bag.

Finally, in order to permit all the water to be quickly drained from the bag after the bulk of the water is pumped back into the pool through one or more of the ports, the bottom of the bag is provided with four sealable drain holes, one of which is located closely adjacent to each of the four corners of the bottom of the bag.

Since the bag when in use sits on ground near the pool which usually is not entirely level, it is necessary in order to quickly and entirely empty the bag of all its water to have a sealable drain hole adjacent each of the four corners of the bag. It is essential that the bag be entirely empty in order to fold the bag so it will conveniently fit onto the trailer or truck used to move the bag from the pool site.

While I prefer the square form of the bag, it may be made in other forms provided that the bag contain a vent in the top of the bag, a plurality of sealable ports in the side of the bag, and a plurality of sealable drain holes spaced along the outer edge of the bottom of the bag.

BRIEF DESCRIPTION OF THE DRAWINGS

My unique collapsible storage bag and its advantages will be best understood from the following detailed description and the attached drawings in which:

FIG. 1 is an elevational side view of a preferred form of my collapsible storage bag resting on the ground.

FIG. 2 is a plan view taken from below partially broken away of the collapsible storage bag shown in FIG. 1.

FIG. 3 is a detailed exploded view of the components which make up the filling and emptying ports in the side of the storage bag shown in FIGS. 1 and 2.

FIG. 4 is a detailed exploded view of the components which make up the sealable drain holes in the bottom of the storage bag shown in FIGS. 1 and 2.

DETAILED DESCRIPTION OF THE E PREFERRED EMBODIMENT

Referring to FIGS. 1 and 2 of the drawings, a collapsible storage bags 11 is formed from two layers or sheets of impervious sheeting, preferably polyvinyl or poly blend sheeting which is both strong and flexible. Since most pools, spas and jacuzzi contain less than 15,000 gallons of water, I construct my storage bag from two sheets 24 feet by 24 feet square. With the outer edges of the sheets securely joined together, the gab will hold about 15,000 gallons of water.

As shown in FIGS. 1 and 2, a vent 12 is installed at or near the center of the top sheet of bag 11 in order to permit escape of air trapped in the bag as it si filled with water.

In order to quickly pump water out of the pool and into bag 11, three filling and emptying ports 13, 14 and 15 are installed along the side of bag 11. The construction of ports 13, 14 and 15 are illustrated in FIG. 3.

As shown in FIG. 3, a circular hole is cut in bag 11 sized to admit the threaded wend of port 13*a* preferably made of polyvinyl chloride (PVC) and surrounded by neoprene seal 13*b*. The port 13*a* is firmly sealed onto bag 11 by neoprene seal 13*c*, PVC pressure plat 13*d* and PVC lock ring 13*e*. Similar elements are used to form ports 14 and 15. While not shown in the drawings, each of ports 13, 14 and 15 are sealable by conventional means , so that if less than three ports are being used to fill or empty the bag, water will not leak out of the bag through the unused port.

In order to facilitate quick and complete emptying of the bag after the bulk of the pool water has been pumped out of the bag and back into the pool, four similar drain holes 16, 17, 18 and 19 are installed closely adjacent the four corners of the bottom sheet 11A of the bag as best shown in FIG. 2. Because bag 11 rests normally upon ground which is not truely level, water tends to accumulate near the lowermost corner or corners of the bag and hence it is important that there be a drain hole adjacent to each of the four corners of the bottom 11A of the bag.

The preferred construction of each of the sealable drain holes is shown in FIG. 4. A circular hole sized to bag 11. Fitting 16*a* is preferably made of PVC and surrounded by neoprene seal 16*b*. Fitting 16*a* is firmly sealed onto bag 11 by neoprene seal 16*c*, PVC pressure plate 16*d* and PVC lock ring 16*e*. When not in use to drain water out of bag 11, drain hole 16 is securely sealed by O-ring 16*f*, PVC seal plate 16*g* and PVC cap 16*h* screwed onto fitting 16*a* as shown in FIG. 4. Similar elements are used to form drain holes 17, 18 and 19.

While I have shown in FIGS. 1, 2, 3 and 4 and described in detail the preferred embodiment of my collapsible bag, it will be apparent to those skilled in the art that modifications can be made without departing from the scope and spirit of my invention. No limitations should be implied from the description of the preferred embodiment and the scope of my invention is limited only by the appended claims.

I claim:

1. A flexible collapsible storage bag for holding large volumes of liquid designed for rapid filling and for rapid and complete emptying of its liquid contents when the bag rests on an uneven surface fabricated in its empty and collapsed condition in a rectangular shape comprising an upper sheet of imperious flexible sheeting in a generally rectangular shape, a lower sheet of impervious flexible sheeting sized similar to the upper sheet in a generally rectangular shape whose outer edges are securely joined to the outer edges of the upper sheet of sheeting to form the storage bag, an open vent located at the center of the upper sheet of sheeting, plurality of sealable filling and emptying ports located along one side of the upper sheet of sheeting, and four sealable dragon holes each one located closely adjacent to on of the four corners of the lower sheet of sheeting to insure rapid and complete emptying of the bag's liquid contents when the bag rests on an uneven surface.

2. A flexible and collapsible storage bag as set forth in claim 1 wherein the bag is made of polyvinyl sheeting.

3. A flexible and collapsible storage bag as set forth in claim 1 wherein the bag in its empty and collapsed condition from a square.

4. A flexible and collapsible storage bag as set forth in claim 1 wherein the bag includes three similar sealable filling and emptying ports spaced apart along one side of the upper sheet of sheeting.

5. A collapsible storage bag for holding lace volumes of liquid designed for rapid filling and for rapid and complete emptying of its liquid contents when the bag rests on an uneven surface comprising an upper sheet of impervious flexible sheeting, a lower sheet of impervious flexible sheeting sized similar to the upper sheet whose outer edges are securely joined to the outer edges of the upper sheet of sheeting to form the storage bag, an open vent located at the center of the upper sheet of sheeting, one or more sealable filling and emptying ports located along one side of the upper sheet of sheeting, and a plurality of at least four sealable drain holes equally spaced apart and each located closely adjacent to the outer edge of the lower sheet of sheeting to insure rapid and complete emptying of the bag's liquid contents when the bag rests on an uneven surface.

6. A flexible and collapsible storage bag as set forth in claim 5 wherein the bag is made of polyvinyl sheeting.

7. A flexible and collapsible storage bag as set forth in claim 5 wherein the bag in its empty and collapsed condition from a square.

8. A flexible and collapsible storage bag as set forth in claim 5 wherein the bag includes three similar sealable filling and emptying ports paced apart along one side of the upper sheet of sheeting.

* * * * *